US011154967B2

(12) United States Patent
Chen

(10) Patent No.: US 11,154,967 B2
(45) Date of Patent: Oct. 26, 2021

(54) RATCHET WRENCH

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 216 days.

(21) Appl. No.: 16/572,634

(22) Filed: Sep. 17, 2019

(65) Prior Publication Data

US 2021/0078141 A1 Mar. 18, 2021

(51) Int. Cl.
*B25B 13/46* (2006.01)
*B25B 13/48* (2006.01)

(52) U.S. Cl.
CPC ..... *B25B 13/463* (2013.01); *B25B 13/481* (2013.01)

(58) Field of Classification Search
CPC ..... B25B 13/463; B25B 13/481
USPC ..... 81/62, 63.1
See application file for complete search history.

(56) References Cited

U.S. PATENT DOCUMENTS 4,592,256 A * 6/1986 Bosque ..... B25B 17/00 81/57.13
5,782,147 A * 7/1998 Chaconas ..... B25B 13/463 192/43.1
9,649,751 B2 * 5/2017 Huang ..... B25B 13/463
2004/0089108 A1 * 5/2004 Chang ..... B25B 13/465 81/62

* cited by examiner

*Primary Examiner* — Hadi Shakeri

(57) ABSTRACT

A ratchet wrench includes a head with a ratchet wheel, a first pawl unit and a second pawl unit received therein. The first pawl unit includes a first pawl and a second pawl, and the second pawl unit includes a third pawl and a fourth pawl. The first and second pawl units are controlled to be engaged with the ratchet wheel so as to provide sufficient number of teeth to be engaged with the ratchet wheel. The ratchet wrench outputs sufficient torque with a small angle of rotation.

7 Claims, 7 Drawing Sheets

RATCHET WRENCH

BACKGROUND OF THE INVENTION

1. Fields of the Invention

The present invention relates to a ratchet wrench, and more particularly, to a ratchet wrench suitable for small angular action.

2. Descriptions of Related Art

The conventional ratchet wrench generally includes a ratchet wheel which is cooperated with a pawl unit so as to be reciprocated to output torque without removing the wrench from the object and re-mounting the wrench to the object. It is well known that the more number of the ratchets is equipped, the less angle that the wrench needs to be rotated to output torque. The number of the ratchet is restricted mainly by the size of the ratchet wheel. The minimum angle that the conventional ratchet wrenches rotate to output a torque is 5 degrees. However, there is a need for the ratchet wrenches to drive small parts in a narrow space, without compromise of the output torque and the angle that the ratchet wrench can output torque is a concern for the applicant.

The present invention intends to provide a ratchet wrench to eliminate the shortcomings mentioned above.

SUMMARY OF THE INVENTION

The present invention relates to a ratchet wrench and comprises a head and a handle, wherein the head has a recess which communicates with the underside of the head. A first bore and a second bore are respectively defined through the top board of the head. A ratchet wheel is accommodated in the recess and has multiple ratchets. The ratchet wheel is rotatably connected to the first bore. A first pawl unit is pivotably connected to the peripheral wall of the recess, and the first pawl unit includes a first pawl and a second pawl. Two first springs are respectively biased between the first and second pawls and the peripheral wall of the recess. The first and second pawls are detachably engaged with the ratchets of the ratchet wheel.

A second pawl unit is pivotably connected to the peripheral wall of the recess. The second pawl unit includes a third pawl and a fourth pawl. Two second springs are respectively biased between the third and fourth pawls and the peripheral wall of the recess. The third and fourth pawls are detachably engaged with the ratchets of the ratchet wheel.

A switch unit includes a rod and a lever. The rod extends through the second bore from the top of the head and is located between the first and second pawl units. The lever controls the rod to drive the first pawl and the second pawl to be alternatively engaged with the ratchet wheel, or the lever controls the rod to drive the third pawl and the fourth pawl to be alternatively engaged with the ratchet wheel.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
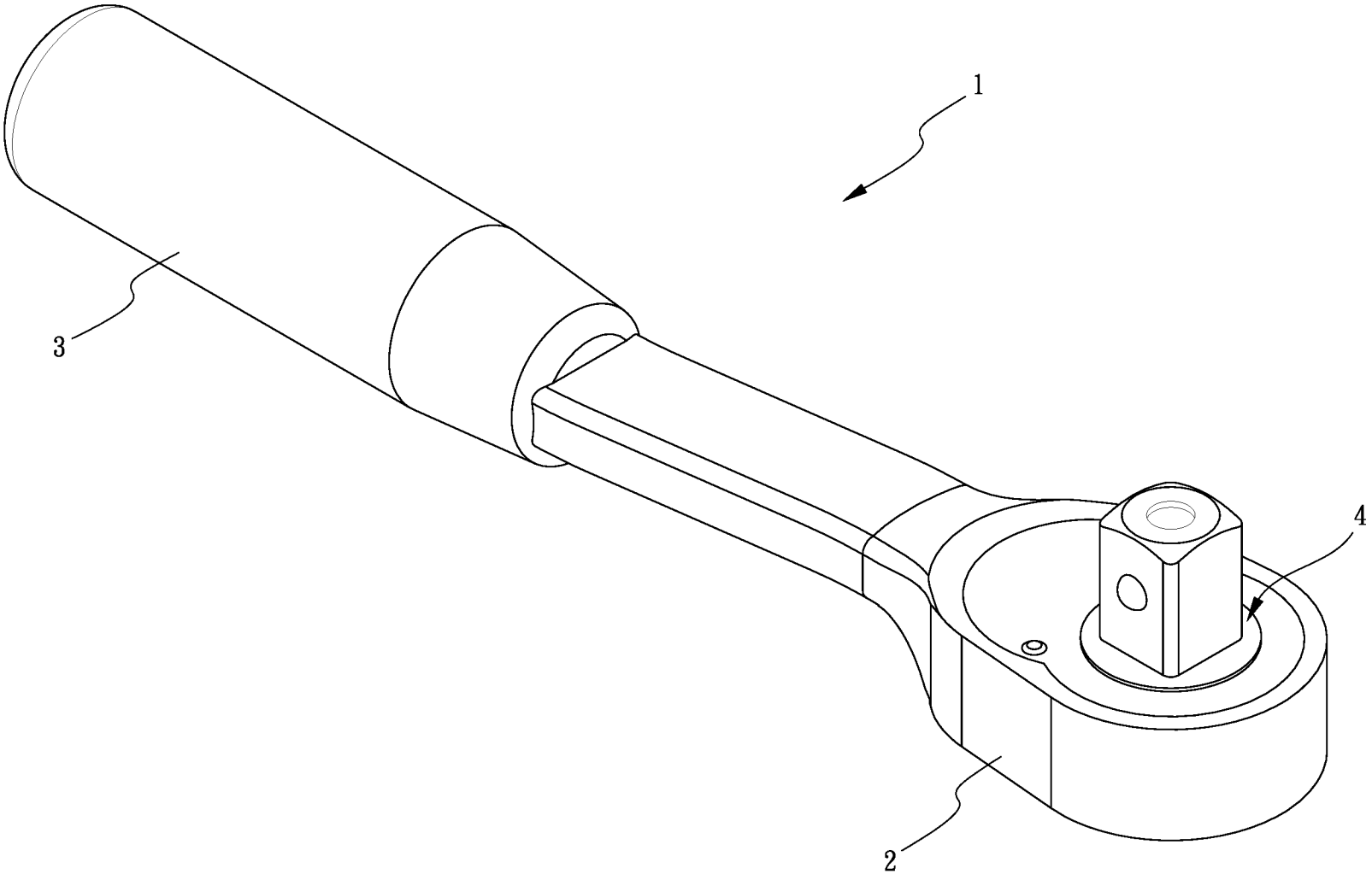
FIG. 1 is a perspective view to show the ratchet wrench of the present invention.
Figure 2:
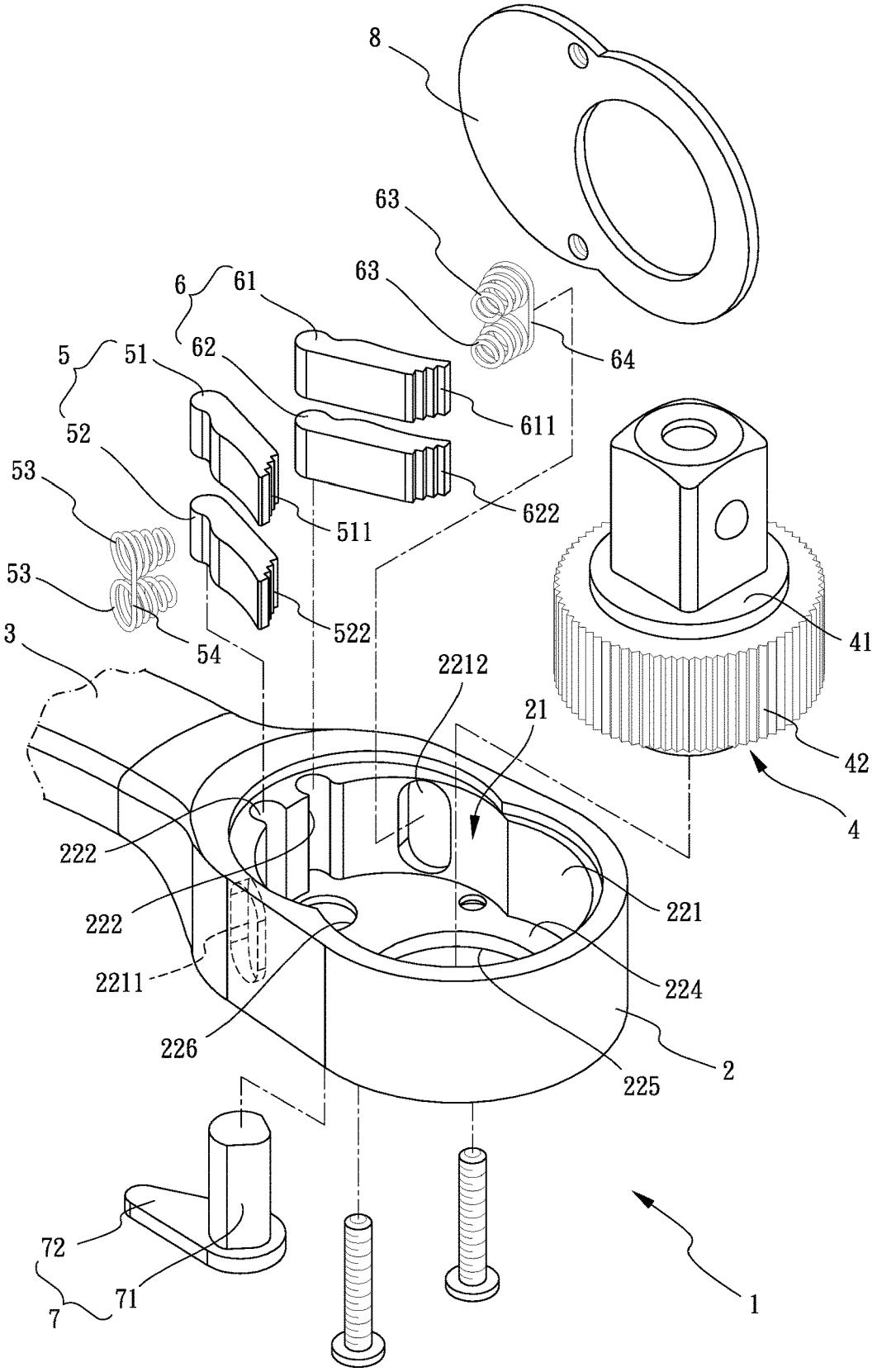
FIG. 2 is an exploded view to show the ratchet wrench of the present invention.
Figure 3:
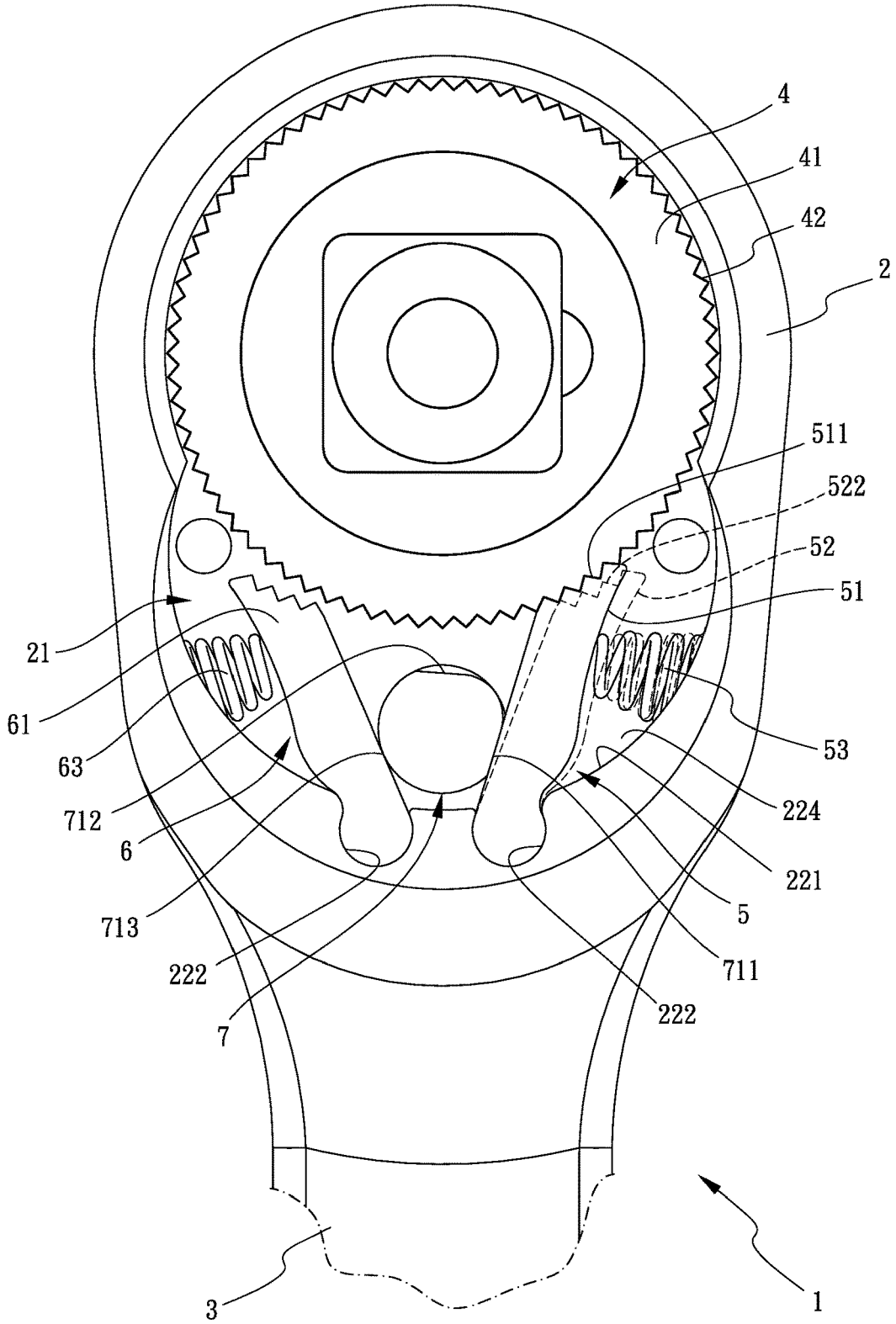
FIG. 3 shows that the first teeth are engaged with the ratchet wheel.

Referring to FIGS. 1 to 3, the ratchet wrench 1 of the present invention comprises a head 2 and a handle 3 which extends from the head 3. The head 2 includes a recess 21 defined therein and communicates with the first side or the underside of the head 2. It is noted that the first side or the underside of the head 2 in the drawings are shown upward for clarity purpose. The peripheral wall 221 of the recess 21 includes two groves 222 defined therein. Each groove 222 includes a partial round inner periphery, and an entrance communicates with the recess 21. The entrance is sized such that the first, second, third and fourth pawls 51, 52, 61, 62 do not drop from the entrance. A first bore 225 and a second bore 226 are respectively defined through the top board 224 on the second side or the top of the head 2. A ratchet wheel 4 is accommodated in the recess 21 and has a body 41 which has multiple ratchets 42 formed in the outer periphery of the body 41. The ratchet wheel 4 is rotatably connected to the first bore 225.

Figure 7:
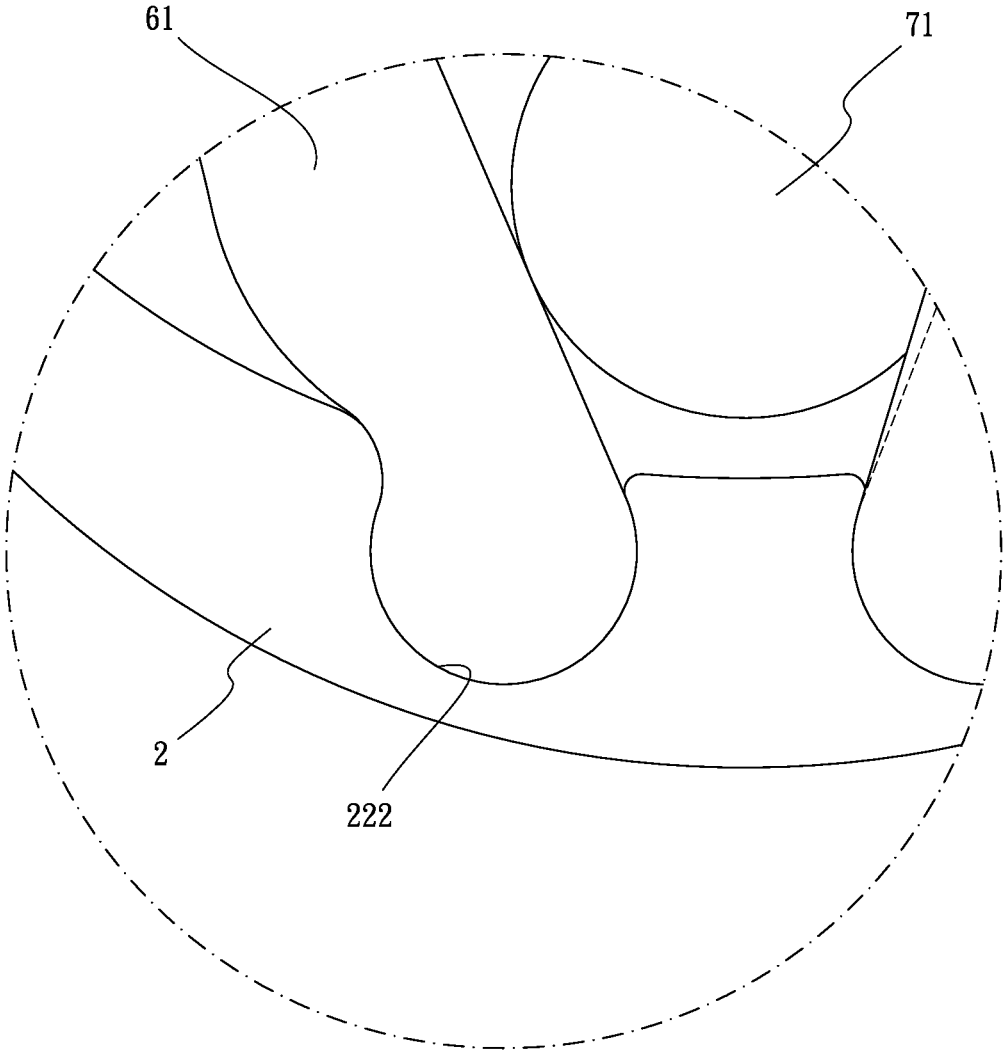
FIG. 7 is an enlarged view to show the first and second pivotal units pivotably engaged with the grooves.

Further referring to FIG. 7, a first pawl unit 5 is located in the recess 21 and includes a first pawl 51 and a second pawl 52. The first and second pawls 51, 52 each have one end pivotably engaged with one of the two grooves 222. The other end of the first pawl 51 has first teeth 511, and the other end of the second pawl 52 has second teeth 522. The first and second pawls 51, 52 are pivoted about the groove 222. Two first springs 53 are respectively biased between the first and second pawls 51, 52 and the peripheral wall 221 of the recess 21. The first and second teeth 511, 522 are detachably engaged with the ratchets 42 of the ratchet wheel 4. It is noted that the first teeth 511 and the second teeth 522 are located alternatively to each other. When the first teeth 511 are engaged with the ratchets 42 of the ratchet wheel 4, a portion of the second teeth 522 only contact the ratchets 42 of the ratchet wheel 4, but are not engaged with the ratchets 42 of the ratchet wheel 4, vice versa.

A second pawl unit 6 is located in the recess 21 and includes a third pawl 61 and a fourth pawl 62. The third and fourth pawls 61, 62 each have one end pivotably engaged with another of the two grooves 222. The other end the third pawl 61 has third teeth 611, and the other end of the fourth pawl 62 has fourth teeth 622. The third and fourth pawls 61, 62 are pivotably engaged with another of the two grooves 222. Two second springs 63 are respectively biased between the third and fourth pawls 61, 62 and the peripheral wall 221 of the recess 21. The third and fourth teeth 611, 622 are detachably engaged with the ratchets 42 of the ratchet wheel 4. It is noted that the third teeth 611 and the fourth teeth 622 are located alternatively to each other. When the third teeth 611 are engaged with the ratchets 42 of the ratchet wheel 4, a portion of the fourth teeth 622 only contact the ratchets 42 of the ratchet wheel 4, but are not engaged with the ratchets 42 of the ratchet wheel 4, vice versa.

Specifically, a first slot 2211 is defined through the peripheral wall 221 and located corresponding to the first pawl unit 5. The two first springs 53 are two compression springs which are connected to each other by a first connection portion 54. The first connection portion 54 is engaged with the first slot 2211. A second slot 2212 is defined through the peripheral wall 221 and located corresponding to the second pawl unit 6. The two second springs 63 are two compression springs which are connected to each other by a second connection portion 64. The second connection portion 64 is engaged with the second slot 2212.

A switch unit 7 is connected to the ratchet wrench 1 and includes a rod 71 and a lever 72. The rod 71 extends through the second bore 226 from the top of the head 2 and is located between the first and second pawl units 5, 6. The lever 72 is located beyond the head 2 so that the users can operate the lever 72 to control and rotate the rod 71 to drive the first pawl 51 and the second pawl 52 to be alternatively engaged with the ratchet wheel 4 by the first and second teeth 511, 522. Alternatively, the lever 72 is operated to control and rotate the rod 71 to drive the third pawl 61 and the fourth pawl 62 to be alternatively engaged with the ratchet wheel 4 by the third and fourth teeth 611, 622. A bottom cover 8 is fixed to the underside of the head 2 by bolts, and the driving part on the ratchet wheel 4 extends through the bottom cover 8 to be engaged with object such as a socket.

Specifically, the rod 71 includes a first face 711, a second face 712 and a third face 713 respectively defined in the outer periphery thereof. When the first pawl unit 5 or the second pawl unit 6 is engaged with the third face 713, the first pawl unit 5 or the second pawl unit 6 is not engaged with the ratchet wheel 4.

When the first pawl 51 is engaged with the first face 711, the first teeth 511 are engaged with the ratchets 42 of the ratchet wheel 4. When the second pawl 52 is engaged with the first face 711, the second teeth 522 are engaged with the ratchets 42 of the ratchet wheel 4, so that when the ratchet wheel 4 is rotated in a first direction as the arrow head shown in FIG. 4, the first and second teeth 511, 522 are alternatively engaged with the ratchets 42 of the ratchet wheel 4.

Similarly, when the third pawl 61 is engaged with the second face 712, the third teeth 611 are engaged with the ratchets 42 of the ratchet wheel 4. When the fourth pawl 62 is engaged with the second face 712, the fourth teeth 622 are engaged with the ratchets 42 of the ratchet wheel 4, so that when the ratchet wheel 4 is rotated in a second direction, the third and fourth teeth 611, 622 are alternatively engaged with the ratchets 42 of the ratchet wheel 4.

Figure 4:
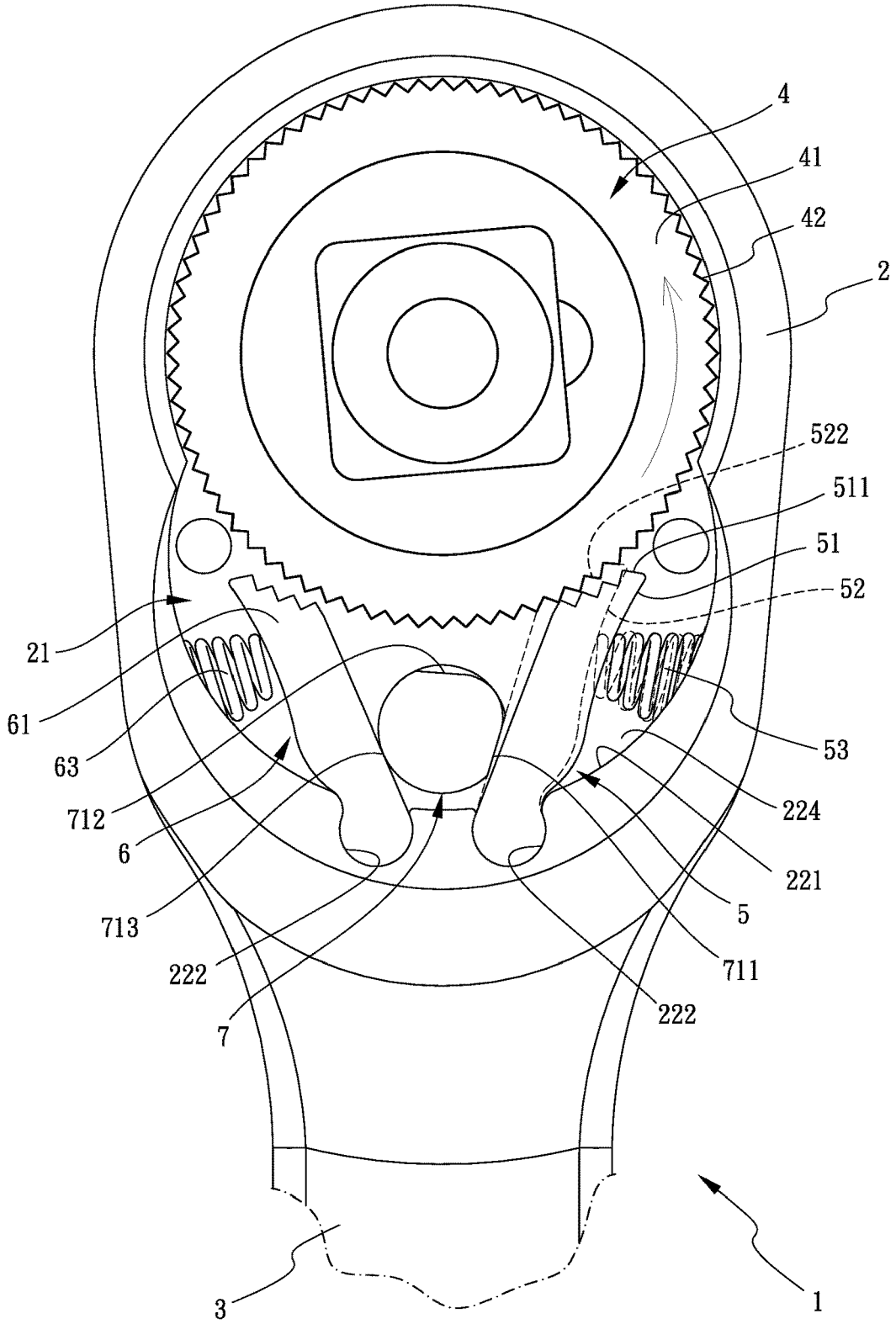
FIG. 4 shows that the second teeth are engaged with the ratchet wheel.

Therefore, when the ratchet wrench 1 is used to tighten an object in a small area, after the ratchet wheel 4 is rotated clockwise (the second direction that is opposite to the first direction of FIG. 4) to output a torque to the object, the ratchet wrench 1 needs only rotates a small angle in the first direction as shown in FIG. 4 an then can output torque again because there are always sufficient first and second teeth 511, 522 engaged with the ratchet wheel 4. The situation will be the same when the third pawl 61 and the fourth pawl 62 are alternatively engaged with the ratchet wheel 4.

Figure 5:
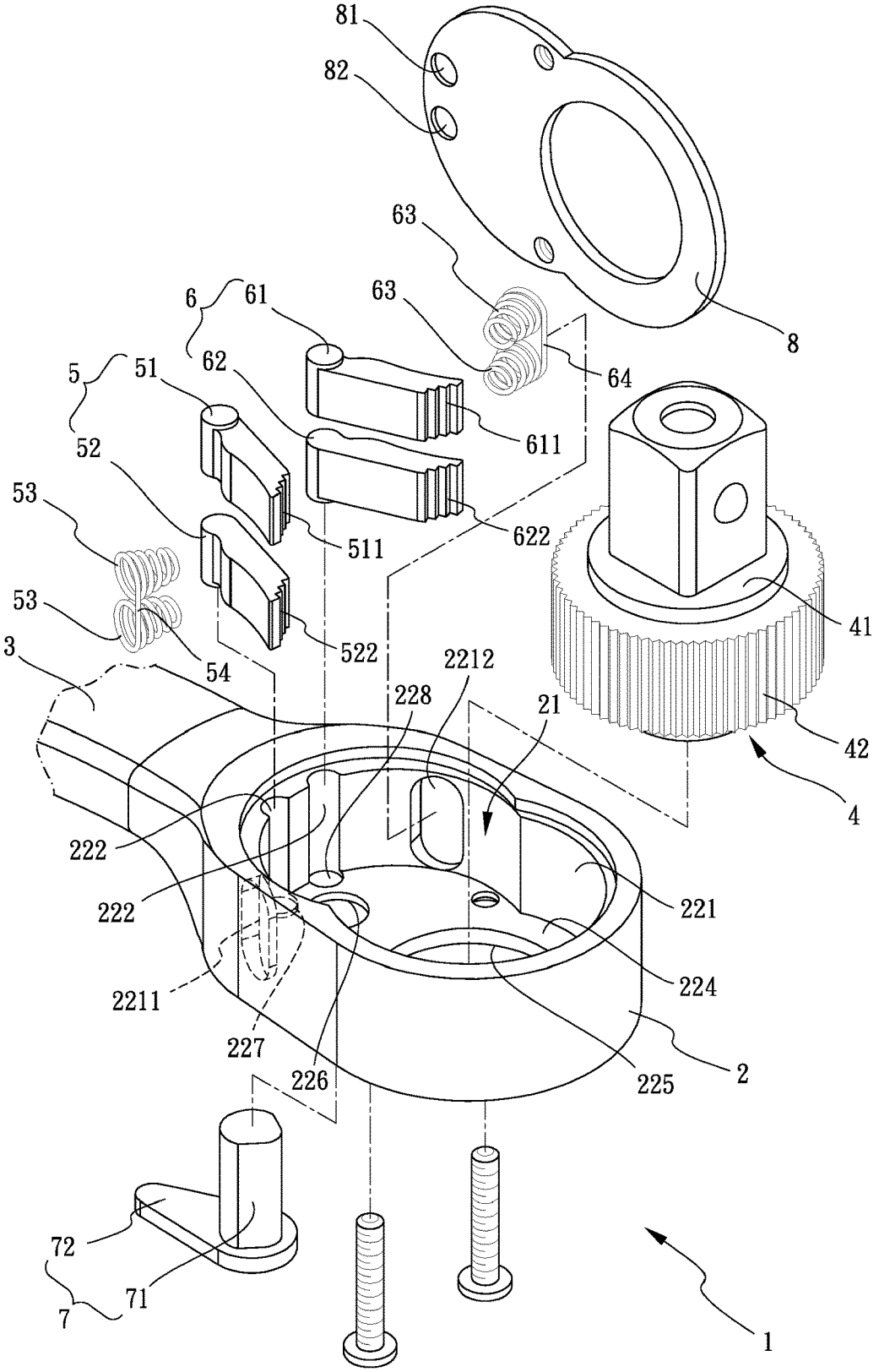
FIG. 5 shows another embodiment of the ratchet wrench of the present invention.

As shown in FIG. 5 which shows another embodiment, the top board 224 includes a first pivotal hole 227 and a second pivotal hole 228. The bottom cover 8 that is connected the underside of the head 2 includes a third pivotal hole 81 and a fourth pivotal hole 82. The first pawl 51 is pivotably connected to the third pivotal hole 81, and the second pawl 52 is pivotably connected to the first pivotal hole 227. The third pawl 61 is pivotably connected to the fourth pivotal hole 82, and the fourth pawl 62 is pivotably connected to the second pivotal hole 228.

Figure 6:
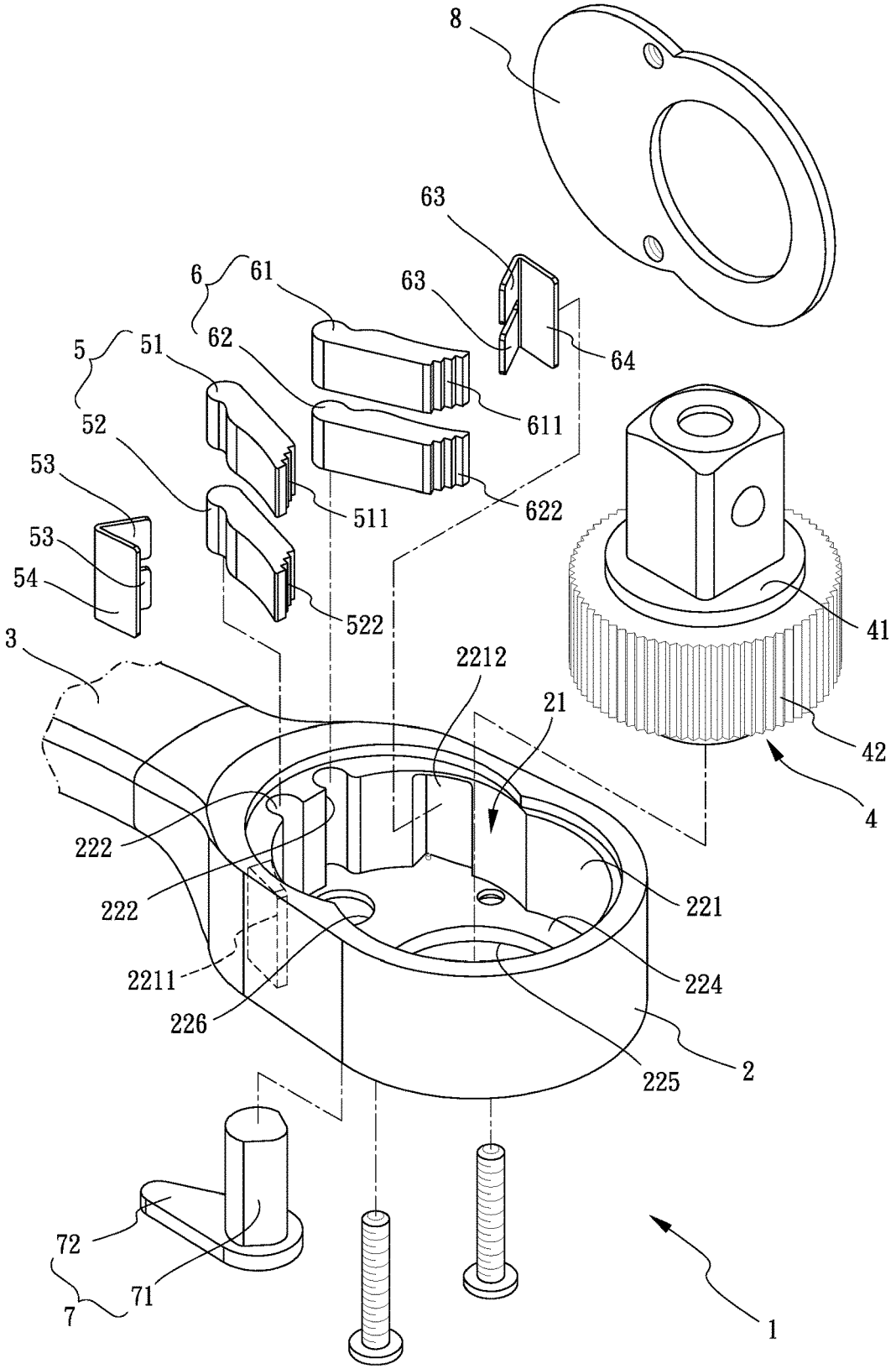
FIG. 6 shows another embodiment of the first and second springs of the ratchet wrench of the present invention.

FIG. 6 shows another embodiment of the first and second springs 53 and 63. The two first springs 53 are two resilient plates which are connected to each other by a first connection portion 54. The first connection portion 54 is engaged with the first slot 2211. The two second springs 63 are two resilient plates which are connected to each other by a second connection portion 64. The second connection portion 64 is engaged with the second slot 2212.

While we have shown and described the embodiment in accordance with the present invention, it should be clear to those skilled in the art that further embodiments may be made without departing from the scope of the present invention.

What is claimed is:

1. A ratchet wrench comprising:

a head and a handle which extends from the head, the head having a recess defined therein and communicating with an underside of the head, a first bore and a second bore respectively defined through a top board of the head;

a ratchet wheel accommodated in the recess and having a body which has multiple ratchets formed in a periphery of the body, the ratchet wheel rotatably connected to the first bore;

a first pawl unit pivotably connected to a peripheral wall of the recess, the first pawl unit including a first pawl and a second pawl, the first pawl having first teeth, the second pawl having second teeth, a first slot defined through the peripheral wall and located corresponding to the first pawl unit, two first springs respectively biased between the first and second pawls and the peripheral wall of the recess, the two first springs being either two compression springs or two resilient plates which are connected to each other by a first connection portion, the first connection portion engaged with the first slot, the first and second teeth detachably engaged with the ratchets of the ratchet wheel;

a second pawl unit pivotably connected to the peripheral wall of the recess, the second pawl unit including a third pawl and a fourth pawl, the third pawl having third teeth, the fourth pawl having fourth teeth, a second slot defined through the peripheral wall and located corresponding to the second pawl unit, two second springs respectively biased between the third and fourth pawls, and the peripheral wall of the recess, the two second springs being either two compression springs or two resilient plates which are connected to each other by a second connection portion, the second connection portion engaged with the second slot, the third and fourth teeth detachably engaged with the ratchets of the ratchet wheel, and a switch unit including a rod and a lever, the rod extending through the second bore from a top of the head and located between the first and second pawl units, the lever located beyond the head, the lever controlling the rod to drive the first pawl and the second pawl to be alternatively engaged with the ratchet wheel by the first and second teeth, or the lever controlling the rod to drive the third pawl and the fourth pawl to be alternatively engaged with the ratchet wheel by the third and fourth teeth.

2. The ratchet wrench as claimed in claim 1, wherein the rod includes a first face, a second face and a third face respectively defined in an outer periphery thereof, when the first pawl unit or the second pawl unit is engaged with the third face, the first pawl unit or the second pawl unit is not engaged with the ratchet wheel, when the first pawl is engaged with the first face, the first teeth are engaged with the ratchets of the ratchet wheel, when the second pawl is engaged with the first face, the second teeth are engaged with the ratchets of the ratchet wheel, so that when the ratchet wheel is rotated in a first direction, the first and second teeth are alternatively engaged with the ratchets of the ratchet wheel, when the third pawl is engaged with the second face, the third teeth are engaged with the ratchets of the ratchet wheel, when the fourth pawl is engaged with the second face, the fourth teeth are engaged with the ratchets of the ratchet wheel, so that when the ratchet wheel is rotated in a second direction, the third and fourth teeth are alternatively engaged with the ratchets of the ratchet wheel.

3. The ratchet wrench as claimed in claim 2, wherein the first teeth and the second teeth are located alternatively to each other, the third teeth and the fourth teeth are located alternatively to each other.

4. The ratchet wrench as claimed in claim 1, wherein the peripheral wall of the recess includes two grooves, the first and second pawls pivotably engaged with one of the two grooves, the third and fourth pawls are pivotably engaged with another of the two grooves.

5. The ratchet wrench as claimed in claim 1, wherein the top board includes a first pivotal hole and a second pivotal hole, a bottom cover is connected the underside of the head and includes a third pivotal hole and a fourth pivotal hole, the first pawl is pivotably connected to the third pivotal hole, the second pawl is pivotably connected to the first pivotal hole, the third pawl is pivotably connected to the fourth pivotal hole, the fourth pawl is pivotably connected to the second pivotal hole.

6. The ratchet wrench as claimed in claim 1, wherein the two first springs are two resilient plates.

7. The ratchet wrench as claimed in claim 1, wherein the two first springs are two compression springs.

* * * * *